US008710813B2

(12) United States Patent
Yang et al.

(10) Patent No.: US 8,710,813 B2
(45) Date of Patent: Apr. 29, 2014

(54) LOW DROP-OUT REGULATOR PROVIDING CONSTANT CURRENT AND MAXIMUM VOLTAGE LIMIT

(75) Inventors: Ta-Yung Yang, Taoyuan (TW); Jenn-Yu Lin, Taipei Hsien (TW)

(73) Assignee: System General Corp., Taipei Hsien (TW)

( * ) Notice: Subject to any disclaimer, the term of this patent is extended or adjusted under 35 U.S.C. 154(b) by 199 days.

(21) Appl. No.: 12/420,324

(22) Filed: Apr. 8, 2009

(65) Prior Publication Data

US 2009/0256540 A1 Oct. 15, 2009

(51) Int. Cl.
*G05F 1/565* (2006.01)
*G05F 1/575* (2006.01)

(52) U.S. Cl.
USPC ..... 323/281; 323/274; 323/275; 323/285

(58) Field of Classification Search
USPC ..... 323/273, 274, 275, 279, 280, 281, 315, 323/901
See application file for complete search history.

(56) References Cited

U.S. PATENT DOCUMENTS

| | | | | |
|---|---|---|---|---|
| 5,105,102 | A * | 4/1992 | Shioda | 326/73 |
| 5,661,395 | A * | 8/1997 | Johnson et al. | 323/273 |
| 6,188,212 | B1 * | 2/2001 | Larson et al. | 323/281 |
| 6,700,360 | B2 * | 3/2004 | Biagi et al. | 323/280 |
| 6,703,815 | B2 * | 3/2004 | Biagi | 323/280 |
| 7,449,872 | B2 * | 11/2008 | Zolfaghari | 323/314 |
| 7,466,115 | B2 * | 12/2008 | Biagi | 323/280 |
| 7,602,161 | B2 * | 10/2009 | McLeod | 323/273 |
| 7,719,241 | B2 * | 5/2010 | Dean | 323/273 |
| 7,723,968 | B2 * | 5/2010 | Okuyama et al. | 323/274 |
| 7,772,816 | B2 * | 8/2010 | Cho et al. | 323/280 |
| 7,816,897 | B2 * | 10/2010 | Illegems | 323/277 |

* cited by examiner

*Primary Examiner* — Gary L Laxton
(74) *Attorney, Agent, or Firm* — Ming Chow; Sinorica, LLC

(57) ABSTRACT

A low drop-out regulator is disclosed. An unregulated DC input terminal receives an input voltage. A pass circuit is coupled between the unregulated DC input terminal and a regulated DC output terminal for supplying a power to the regulated DC output terminal. An amplifying circuit controls the pass circuit for providing a constant voltage or/and a constant current in response to an output voltage or/and an output current.

24 Claims, 2 Drawing Sheets

LOW DROP-OUT REGULATOR PROVIDING CONSTANT CURRENT AND MAXIMUM VOLTAGE LIMIT

BACKGROUND OF THE INVENTION

1. Filed of Invention

The present invention relates to a regulator, and more particularly, to a low drop-out regulator.

2. Description of Related Art

A constant current is required for charging a rechargeable battery. A low drop-out (LDO) regulator with a constant current and a maximum voltage limit is utilized to charge a rechargeable battery, it can be used to power portable electronic devices, such as laptop computers, mobile phones, digital cameras and MP3 players. The conventional low drop-out regulator is complex.

SUMMARY OF THE INVENTION

An object of the present invention is to provide a simple and low cost circuit for the low drop-out (LDO) regulator with a constant current and a maximum voltage limit.

A low drop-out regulator according to the present invention comprises an unregulated DC input terminal receiving an input voltage. A regulated DC output terminal outputs an output voltage. A pass circuit is coupled between the unregulated DC input terminal and the regulated DC output terminal for supplying a power to the regulated DC output terminal. An amplifying circuit controls the pass circuit for providing a constant voltage or/and a constant current in response to the output voltage or/and an output current.

BRIEF DESCRIPTION OF ACCOMPANIED DRAWINGS

The accompanying drawings are included to provide a further understanding of the present invention, and are incorporated in and constitute a part of this specification. The drawings illustrate embodiments of the present invention and, together with the description, serve to explain the principles of the present invention.

Figure 1:
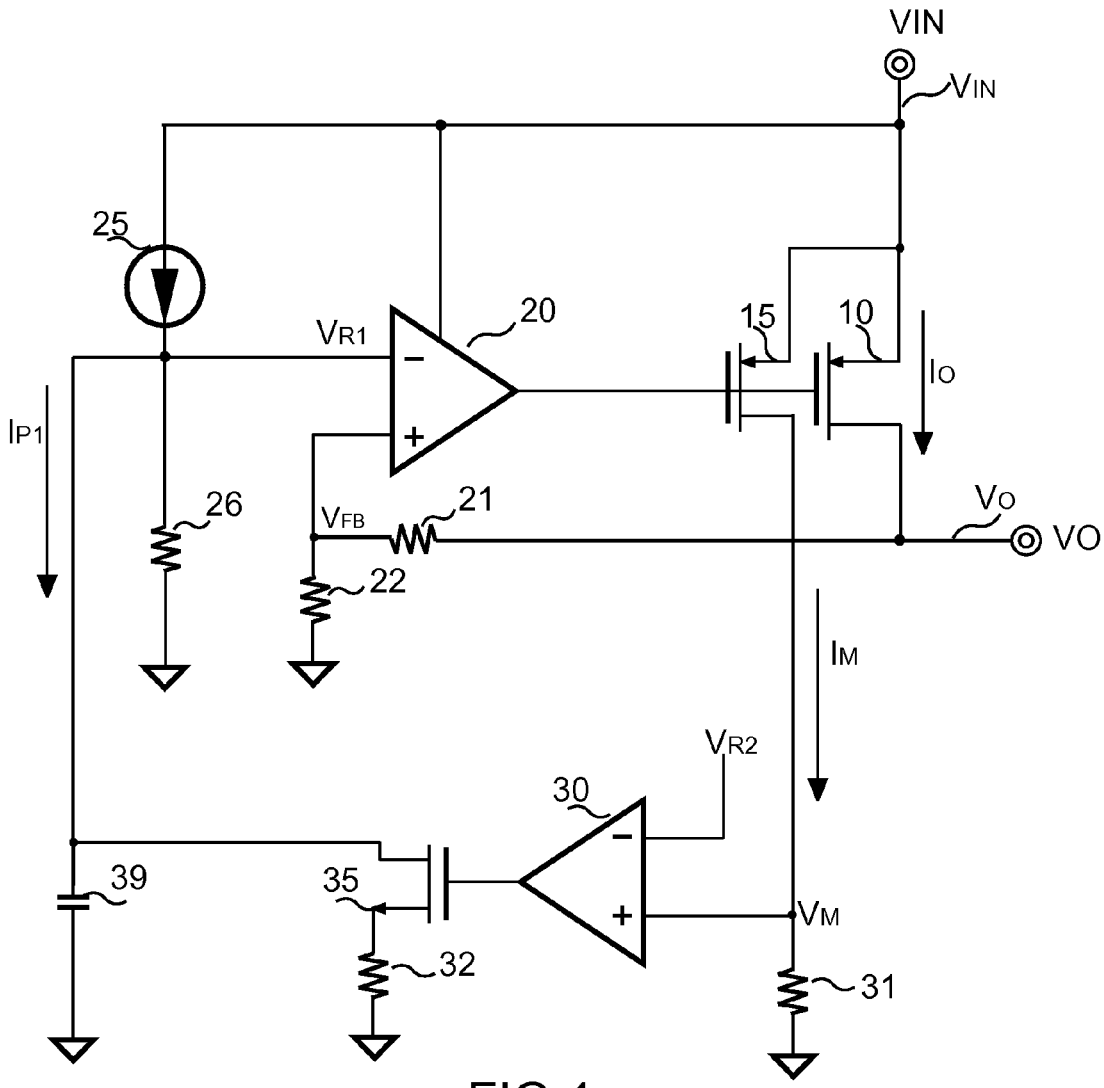
Figure 2:
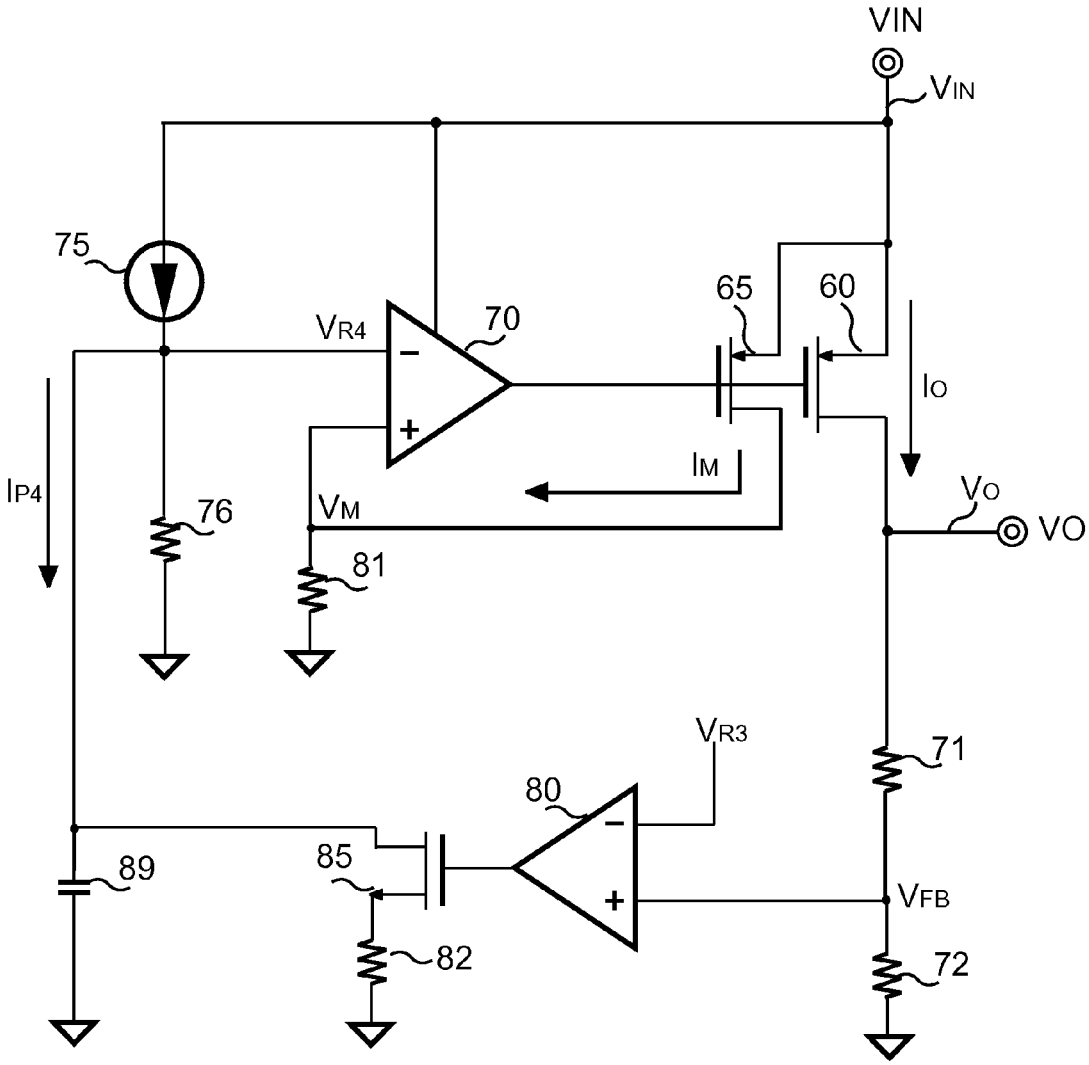

FIG. 1 shows the circuit schematic of a preferred embodiment of a low drop-out regulator according to the present invention; and FIG. 2 shows the circuit schematic of another preferred embodiment of the low drop-out regulator according to the present invention.

DETAILED DESCRIPTION OF PREFERRED EMBODIMENTS

FIG. 1 shows the circuit schematic illustrating one embodiment of a low drop-out regulator according to the present invention. The low drop-out regulator is also a low drop-out regulation circuit. It includes a pass circuit and an amplifying circuit. The pass circuit having an output pass element 10 and a mirror pass element 15. The low drop-out regulator further includes an unregulated DC input terminal VIN and a regulated DC output terminal VO. The unregulated DC input terminal VIN, the regulated DC output terminal VO and the output pass element 10 are used for supplying a power to the regulated DC output terminal VO. The power is an output voltage $V_O$. A source of the output pass element 10 is coupled to the unregulated DC input terminal VIN for receiving an input voltage $V_{IN}$, and a drain of the output pass element 10 is connected to the regulated DC output terminal VO for supplying the power to the regulated DC output terminal VO. It means that the pass circuit can be used for supplying the power to the regulated DC output terminal VO. The regulated DC output terminal VO outputs the output voltage $V_O$.

Referring to FIG. 1, the low drop-out regulator of this embodiment further comprises a resistor 31. The mirror pass element 15 generates a mirror signal $V_M$ at the resistor 31 in response to a mirror current $I_M$ correlated to an output current $I_O$ of the output pass element 10. A source and a gate of the mirror pass element 15 are respectively coupled to the source and a gate of the output pass element 10. A drain of the mirror pass element 15 is coupled to a first terminal of the resistor 31. A second terminal of the resistor 31 is coupled to a ground. The drain of the mirror pass element 15 generates the mirror signal $V_M$ correlated to the output current $I_O$ of the output pass element 10. The output pass element 10 and the mirror pass element 15 can be P-transistor or PMOSFET according to a preferred embodiment of the present invention.

The amplifying circuit is used to control the pass circuit for providing a constant voltage or/and a constant current. The amplifying circuit includes a first amplifier 20 and a second amplifier 30. The low drop-out regulator of this embodiment further comprises a voltage divider formed by resistors 21 and 22. The first amplifier 20 has an output terminal for controlling the gates of the mirror pass element 15 and the output pass element 10. A first input terminal of the first amplifier 20 has a first reference signal $V_{R1}$. A second input terminal of the first amplifier 20 is coupled to the regulated DC output terminal VO to receive a feedback signal $V_{FB}$ through the voltage divider. The feedback signal $V_{FB}$ is correlated to the output voltage $V_O$. The resistors 21 and 22 are connected in series and coupled between the regulated DC output terminal VO and the ground. The voltage divider is further coupled to the second input terminal of the first amplifier 20. A power source of the first amplifier 20 is coupled to the unregulated DC input terminal VIN.

Referring to FIG. 1, the low drop-out regulator of this embodiment further comprises a current source 25, a resistor 26, resistor 32, a transistor 35 and a capacitor 39. The current source 25 is coupled between the first input terminal of the first amplifier 20 and the unregulated DC input terminal VIN. A first terminal of the resistor 26 is coupled to the current source 25 and the first input terminal of the first amplifier 20. A second terminal of the resistor 26 is coupled to the ground. The capacitor 39 is coupled between the first input terminal of the first amplifier 20 and the ground for the soft-start function. The capacitor 39 is charged by the current source 25. The first reference signal $V_{R1}$ is developed by the current source 25 and the resistor 26. The output voltage $V_O$ can be expressed as, $$V_O \frac{R_{21} + R_{22}}{R_{22}} \times V_{R1} \tag{1}$$

where $R_{21}$ and $R_{22}$ are the resistance of the resistors 21 and 22; $V_{R1}$ is the amplitude of the first reference signal $V_{R1}$.

The output terminal of the first amplifier 20 modulates a gate voltage of the output pass element 10 in accordance with the first reference signal $V_{R1}$ and the feedback signal $V_{FB}$. The output voltage $V_O$ is modulated in response to the gate voltage of the output pass element 10 modulated by the first amplifier 20.

The second amplifier 30 is used for programming the first reference signal $V_{R1}$. A first input terminal of the second amplifier 30 has a second reference signal $V_{R2}$. A second input terminal of the second amplifier 30 receives the mirror signal $V_M$ correlated to the output current $I_O$ through the resistor 31 and the mirror pass element 15. An output terminal of the second amplifier 30 is coupled to a gate of the transistor 35. A drain of the transistor 35 is coupled to the capacitor 39, the current source 25 and the resistor 26. The resistor 32 is coupled between a source of the transistor 35 and the ground. The transistor 35 can be N-transistor or NMOSFET according to a preferred embodiment of the present invention. When the mirror signal $V_M$ is lager than the second reference signal $V_{R2}$, the output terminal of the second amplifier 30 modulates a gate voltage of the transistor 35 and a programmable current $I_{P1}$ coupled to the first reference signal $V_{R1}$ and the current source 25. The programmable current $I_{P1}$ is used for programming the first reference signal $V_{R1}$. The programmable current $I_{P1}$ flows through the transistor 35. In other words, the output terminal of the second amplifier 30 is used to modulate the programmable current $I_{P1}$ to program the first reference signal $V_{R1}$.

The output current $I_O$ can be expressed as, $$I_O = k \times \frac{V_{R2}}{R_{31}} \tag{2}$$

where $R_{31}$ is the resistance of the resistor 31; $V_{R2}$ is the amplitude of the second reference signal $V_{R2}$; k is the geometric ratio of the mirror pass element 15 and the output pass element 10. Thus, when the resistance of the resistors 31 and the amplitude of the second reference signal $V_{R2}$ are constant, the output current $I_O$ is a constant current which is limited by the second reference signal $V_{R2}$.

In the exemplary embodiment show in FIG. 1, the operation of the low drop-out regulator of the present invention is as follows. When the output current $I_O$ increases in response to the increase of a load (not shown in FIG. 1) coupled to the regulated DC output terminal VO, the mirror signal $V_M$ will increase in response to the increase of the output current $I_O$. When the mirror signal $V_M$ is lager than the second reference signal $V_{R2}$, an output voltage of the output terminal of the second amplifier 30 increases. The gate voltage of the transistor 35 will increase in response to the increase of the output voltage of the second amplifier 30. In addition, it is well known in the art that the gate voltage of the transistor 35 increases and then a drain-source current of the transistor 35 increases. It means that the programmable current $I_{P1}$ increases when the gate voltage of the transistor 35 increases. Thus, once the output voltage of the second amplifier 30 increases, the gate voltage of the transistor 35 and the programmable current $I_{P1}$ both increase. Further, the first reference signal $V_{R1}$ will decrease in accordance with the increase of the programmable current $I_{P1}$.

Besides, when the first reference signal $V_{R1}$ is smaller than the feedback signal $V_{FB}$ in response to the decrease of the first reference signal $V_{R1}$, an output voltage of the output terminal of the first amplifier 20 increases. In addition, it is well known in the art that the gate voltage of the output pass element 10 increases and a source-drain voltage of the output pass element 10 increases in response to the increase of the output voltage of the output terminal of the first amplifier 20. Therefore, when the output voltage of the first amplifier 20 increases, the gate voltage and the source-drain voltage of the output pass element 10 both increase. Further, the output voltage $V_O$ decreases in response to the increase of the source-drain voltage of the output pass element 10. According to above, once the output current $I_O$ is high, the output current $I_O$ increases, that the mirror signal $V_M$ is lager than the second reference signal $V_{R2}$, the output voltage $V_O$ decreases for achieving constant current. Further, the first amplifier 20 controls the output pass element 10 to decrease the output voltage $V_O$ when the feedback signal $V_{FB}$ is high that the feedback signal $V_{FB}$ is higher than the first reference signal $V_{R1}$.

Moreover, operation conditions of the soft-start function of the present invention are as follows. When the unregulated DC input terminal VIN receives the input voltage $V_{IN}$, the capacitor 39 is charged by the current source 25 for generating the first reference signal $V_{R1}$. The first reference signal $V_{R1}$ increases gradually until reaching a maximum voltage limit. The maximum voltage limit is developed by the default setting of the amplitude of the current source 25 and the resistance of the resistor 26.

Referring to the equation (1), when the resistance of the resistors 21 and 22 is constant, the output voltage $V_O$ is correlated to the first reference signal $V_{R1}$ and is limited by the first reference signal $V_{R1}$. Therefore, the output voltage $V_O$ increases gradually in respond to the increase of the first reference signal $V_{R1}$ for achieving the soft-start function.

Further, referring to the equation (2), the output current $I_O$ is a constant current and is limited by the second reference signal $V_{R2}$ when the resistance of the resistor 31 is constant. In conclusion, this invention disclosures a low drop-out regulator providing the constant current according to the second reference signal $V_{R2}$, the maximum voltage limit according to default setting of the amplitude of the current source 25 and the resistance of the resistor 26, and the soft-start function.

FIG. 2 shows the circuit schematic illustrating another preferred embodiment of the low drop-out regulator according to the present invention. As shown, the low drop-out regulator of this embodiment comprises a pass circuit and an amplifying circuit. The pass circuit includes an output pass element 60 and a mirror pass element 65. The amplifying circuit includes a first amplifier 70 and a second amplifier 80 for controlling the pass circuit for providing the constant voltage or/and the constant current. The low drop-out regulator of this embodiment further comprises a voltage divider formed by the resistors 71 and 72, a current source 75, a resistor 76, resistors 81, 82, a transistor 85 and a capacitor 89. The operation characteristic of the output pass element 60, the mirror pass element 65, the current source 75, the resistors 76, 82, the transistor 85 and the capacitor 89 of this embodiment are the same as the operation characteristic of the output pass element 10, the mirror pass element 15, the current source 25, the resistors 26, 32, the transistor 35 and the capacitor 39 of the first embodiment.

A source of the output pass element 60 is coupled to the unregulated DC input terminal VIN for receiving the input voltage $V_{IN}$, and a drain of the output pass element 60 is connected to the regulated DC output terminal VO for supplying the power to the regulated DC output terminal VO. It means that the pass circuit can be used for supplying the power to the regulated DC output terminal VO. The regulated DC output terminal VO outputs the output voltage $V_O$. A drain of the mirror pass element 65 generates the mirror signal $V_M$ at the resistor 81 in response to the mirror current $I_M$ correlated to the output current $I_O$ of the output pass element 60. A source and a gate of the mirror pass element 65 are respectively coupled to the source and a gate of the output pass element 60. The output pass element 60 and the mirror pass element 65 can be P-transistor or PMOSFET according to this embodiment of the present invention.

The first amplifier 70 has an output terminal coupled to control the gates of the output pass element 60 and the mirror pass element 65. A first input terminal of the first amplifier 70 has a fourth reference signal $V_{R4}$. A second input terminal of the first amplifier 70 is coupled to the resistor 81 to receive the mirror signal $V_M$ correlated to the output current $I_O$. The resistor 81 is coupled between the drain of the mirror pass element 65 and the ground. The resistor 81 is further coupled to the second input terminal of the first amplifier 70. A power source of the first amplifier 70 is coupled to the unregulated DC input terminal VIN. The current source 75 is coupled between the first input terminal of the first amplifier 70 and the unregulated DC input terminal VIN. A first terminal of the resistor 76 is coupled to the current source 75 and the first input terminal of the first amplifier 70. A second terminal of the resistor 76 is coupled to the ground. The capacitor 89 is coupled between the first input terminal of the first amplifier 70 and the ground for the soft-start function. The capacitor 89 is further coupled to the current source 75. The fourth reference signal $V_{R4}$ is developed by the current source 75 and the resistor 76.

The output current $I_O$ shown in FIG. 2 can be expressed as, $$I_O = k \times \frac{V_{R4}}{R_{81}} \tag{3}$$

Where $R_{81}$ is the resistance of the resistor 81; $V_{R4}$ is the amplitude of the fourth reference signal $V_{R4}$; k is the geometric ratio of the mirror pass element 65 and the output pass element 60. Thus, the output current $I_O$ is constant current which is correlated to and limited by the fourth reference signal $V_{R4}$. Further, the output terminal of the first amplifier 70 modulates a gate voltage of the output pass element 60 in accordance with the fourth reference signal $V_{R4}$ and the mirror signal $V_M$. The output voltage $V_O$ is modulated in response to the gate voltage of the output pass element 60 modulated by the first amplifier 70.

The second amplifier 80 is used for programming the fourth reference signal $V_{R4}$ through the resistor 82 and the transistor 85. An output terminal of the second amplifier 80 is coupled to a gate of the transistor 85. A first input terminal of the second amplifier 80 has a third reference signal $V_{R3}$. A second input terminal of the second amplifier 80 is coupled to the regulated DC output terminal VO to receive the feedback signal $V_{FB}$ correlated to the output voltage $V_O$ through the voltage divider having the resistors 71 and 72. The resistors 71 and 72 are connected in series and coupled between the regulated DC output terminal VO and the ground. The voltage divider is further coupled to the second input terminal of the second amplifier 80. The transistor 85 can be N-transistor or NMOSFET according to this embodiment.

A drain of the transistor 85 is coupled to the capacitor 89, the current source 75 and the resistor 76. The resistor 82 is coupled between a source of the transistor 85 and the ground. When the feedback signal $V_{FB}$ is large than the third reference signal $V_{R3}$, the output terminal of the second amplifier 80 controls the gate of the transistor 85 and a programmable current $I_{P4}$ coupled to the fourth reference signal $V_{R4}$ and the current source 75. The programmable current $I_{P4}$ is used for programming the fourth reference signal $V_{R4}$. The programmable current $I_{P4}$ flows through the transistor 85. In other words, the output terminal of the second amplifier 80 is used to modulate the programmable current $I_{P4}$ to program the fourth reference signal $V_{R4}$.

The output voltage $V_O$ shown in FIG. 2 can be expressed as, $$V_O = \frac{R_{71} + R_{72}}{R_{72}} \times V_{R3} \tag{4}$$

where $R_{71}$ and $R_{72}$ are resistance of the resistors 71 and 72; $V_{R3}$ is amplitude of the third reference signal $V_{R3}$. Thus, when the resistance of the resistor 71 and 72 is constant, the output voltage $V_O$ is limited by the third reference signal $V_{R3}$. It means that the third reference signal $V_{R3}$ is the maximum voltage limit.

Referring description of FIG. 1, the skill in the art well known that the operation of the low drop-out regulator of the present invention show in FIG. 2 is as follows. When the output voltage $V_O$ increases in response to the decrease of a load (not shown in FIG. 2) coupled to the regulated DC output terminal VO, the feedback signal $V_{FB}$ will increase in response to the increase of the output voltage $V_O$. When the feedback signal $V_{FB}$ is lager than the third reference signal $V_{R3}$, an output voltage of the output terminal of the second amplifier 80 increases. A gate voltage of the transistor 85 will increase in response to the increase of the output voltage of the second amplifier 80. In addition, it is well known in the art that a drain-source current of the transistor 85 increases when the gate voltage of the transistor 85 increases. It means that the programmable current $I_{P4}$ increases when the gate voltage of the transistor 85 increases. Thus, when the output voltage of the second amplifier 80 increases, the gate voltage of the transistor 85 and the programmable current $I_{P4}$ both increase. Further, the fourth reference signal $V_{R4}$ will decrease in accordance with the increase of the programmable current $I_{P4}$.

Besides, when the fourth reference signal $V_{R4}$ is smaller than the mirror signal $V_M$, an output voltage of the output terminal of the first amplifier 70 increases. In addition, it is well known in the art that the gate voltage of the output pass element 60 increases and a source-drain voltage of the output pass element 60 increases in response to the increase of the output voltage of the output terminal of the first amplifier 70. Therefore, when the output voltage of the first amplifier 70 increases, the gate voltage and the source-drain voltage of the output pass element 60 both increase. Further, the output voltage $V_O$ decreases in response to the increase of the source-drain voltage of the output pass element 60. In other words, the output voltage $V_O$ decreases in responses to the increase of the gate voltage of the output pass element 60. According to above, it means that once the output voltage $V_O$ increases and the feedback signal $V_{FB}$ is lager than the third reference signal $V_{R3}$, the output voltage $V_O$ decreases and is limited by the third reference signal $V_{R3}$ for achieving maximum voltage limit function.

Once the output current $I_O$ of the output pass element 60 increases in response to the increase of the load, the mirror signal $V_M$ will increase in response to the increase of the output current $I_O$. When the mirror signal $V_M$ is lager than the fourth reference signal $V_{R4}$, the output voltage of the output terminal of the first amplifier 70 and the gate voltage of the output pass element 60 both increases. Therefore, the source-drain voltage of the output pass element 60 increases in response to the increase of the gate voltage of the output pass element 60. Then, the output voltage $V_O$ decreases in response to the increase of the source-drain voltage of the output pass element 60 for achieving constant current.

Once the mirror signal $V_M$ is lower than the fourth reference signal $V_{R4}$, the output voltage of the output terminal of the first amplifier 70 decreases. It means that the gate voltage of the output pass element 60 decreases. Therefore, the source-drain voltage of the output pass element 60 decreases in response to the decrease of the gate voltage of the output pass element 60. Then, the output voltage $V_O$ increases in response to the decrease of the source-drain voltage of the output pass element 60 for providing constant voltage.

According to above, the first amplifier 70 controls the output pass element 60 of the pass circuit to decrease the output voltage $V_O$ when the output current $I_O$ is high that the mirror signal $V_M$ is higher than the fourth reference signal $V_{R4}$. The first amplifier 70 controls the output pass element 60 of the pass circuit to increase the output voltage $V_O$ when the output current $I_O$ is low that the mirror signal $V_M$ is lower than the fourth reference signal $V_{R4}$.

Moreover, operating conditions of the soft-start function of the present invention show in FIG. 2 are as follows. When the unregulated DC input terminal VIN receives the input voltage $V_{IN}$, the capacitor 89 is charged by the current source 75 for generating the fourth reference signal $V_{R4}$. The fourth reference signal $V_{R4}$ increases gradually until reaching a maximum limit. The maximum limit is developed by the default setting of the amplitude of the current source 75 and the resistance of the resistor 76.

Referring to the equation (3), the output current $I_O$ is correlated to the fourth reference signal $V_{R4}$ and is limited by the fourth reference signal $V_{R4}$ when the resistance of the resistor 81 is constant. Therefore, the output current $I_O$ increases gradually in respond to the increase of the fourth reference signal $V_{R4}$.

Further, referring to the equation (4), the output voltage $V_O$ is a constant voltage which is limited by the third reference signal $V_{R3}$. In other words, the third reference signal $V_{R3}$ is the maximum voltage limit of this embodiment. In conclusion, this invention show in FIG. 2 disclosures a low drop-out regulator providing the maximum voltage limit according to the third reference signal $V_{R3}$, the soft-start function and the constant current according to default setting of the amplitude of the current source 75 and the resistance of the resistor 76.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims or their equivalents.

What is claimed is:

1. A low drop-out regulator comprising:

an unregulated DC input terminal, for receiving an input voltage;

a regulated DC output terminal;

an output pass element, for supplying a power to said regulated DC output terminal, a source of said output pass element coupled to said unregulated DC input terminal, a drain of said output pass element connected to said regulated DC output terminal;

a mirror pass element, for generating a mirror signal, a source and a gate of said mirror pass element being respectively coupled to said source and a gate of said output pass element, a drain of said mirror pass element generating said mirror signal correlated to an output current of said output pass element;

a first amplifier, having an output terminal coupled to control said gate of said output pass element, a first input terminal of said first amplifier having a first reference signal, a second input terminal of said first amplifier coupled to said regulated DC output terminal; and a second amplifier, having an output terminal coupled to program said first reference signal, a first input terminal of said second amplifier having a second reference signal, a second input terminal of said second amplifier coupled to receive said minor signal.

2. The low drop-out regulator as claimed in claim 1, wherein said first reference signal is developed by a current source and a resistor, said current source is coupled to said first input terminal of said first amplifier, said resistor is coupled between said first input terminal of said first amplifier and a ground.

3. The low drop-out regulator as claimed in claim 2, further comprising a capacitor coupled to said first input terminal of said first amplifier for a soft-start function.

4. The low drop-out regulator as claimed in claim 1, wherein said output terminal of said second amplifier modulates a programmable current coupled to said first reference signal to program said first reference signal.

5. The low drop-out regulator as claimed in claim 4, wherein said programmable current flows through a transistor coupled to said output terminal of said second amplifier, said output terminal of said second amplifier controls a gate of said transistor for modulating said programmable current.

6. The low drop-out regulator as claimed in claim 1, wherein said second input terminal of said first amplifier is coupled to said regulated DC output terminal to receive a feedback signal to control said gate of said output pass element for controlling said output voltage in response to said feedback signal and said first reference signal, said feedback signal is correlated to an output voltage.

7. A low drop-out regulation circuit comprising:

an unregulated DC input terminal, for receiving an input voltage;

a regulated DC output terminal;

an output pass element, for supplying a power to said regulated DC output terminal, a source of said output pass element coupled to said unregulated DC input terminal, a drain of said output pass element connected to said regulated DC output terminal;

a mirror pass element, for generating a mirror signal, a source and a gate of said mirror pass element being respectively coupled to said source and a gate of said output pass element, a drain of said mirror pass element generating said mirror signal correlated to an output current of said output pass element;

a first amplifier, having an output terminal coupled to control said gate of said output pass element, a first input terminal of said first amplifier having a fourth reference signal, a second input terminal of said first amplifier coupled to receive said mirror signal; and a second amplifier, having an output terminal coupled to program said fourth reference signal, a first input terminal of said second amplifier having a third reference signal, a second input terminal of said second amplifier coupled to said regulated DC output terminal.

8. The low drop-out regulation circuit as claimed in claim 7, wherein said fourth reference signal is developed by a current source and a resistor, said current source is coupled to said first input terminal of said first amplifier, said resistor is coupled between said first input terminal of said first amplifier and a ground.

9. The low drop-out regulation circuit as claimed in claim 8, further comprising a capacitor coupled to said first input terminal of said first amplifier for a soft-start function.

10. The low drop-out regulation circuit as claimed in claim 7, wherein said output terminal of said second amplifier modulates a programmable current coupled to said fourth reference signal to program said fourth reference signal.

11. The low drop-out regulation circuit as claimed in claim 10, wherein said programmable current flows through a transistor coupled to said output terminal of said second amplifier, said output terminal of said second amplifier controls a gate of said transistor for modulating said programmable current.

12. The low drop-out regulation circuit as claimed in claim 7, wherein said second input terminal of said second amplifier is coupled to said regulated DC output terminal to receive a feedback signal to program said fourth reference signal in response to said feedback signal and said third reference signal, said feedback signal is correlated to an output voltage.

13. A low drop-out regulator comprising:

an unregulated DC input terminal, receiving an input voltage;

a regulated DC output terminal;

a pass circuit, coupled between said unregulated DC input terminal and said regulated DC output terminal for supplying a power to said regulated DC output terminal; and an amplifying circuit, controlling said pass circuit of said low drop-out regulator for providing a constant voltage or/and a constant current in response to a first reference signal and an output voltage;

wherein said first reference signal is utilized to judge said output voltage for controlling said pass circuit; said first reference signal is programmed in response to an output current.

14. The low drop-out regulator as claimed in claim 13, wherein said pass circuit includes:

an output pass element, coupled between said unregulated DC input terminal and said regulated DC output terminal for supplying said power to said regulated DC output terminal; and a mirror pass element, coupled to said output pass element for generating a mirror signal correlated to said output current;

wherein said amplifying circuit controls said output pass element for providing said constant voltage or/and said constant current in response to said mirror signal.

15. The low drop-out regulator as claimed in claim 13, wherein said amplifying circuit includes:

a first amplifier, coupled to said regulated DC output terminal to judge said output voltage in response to said first reference signal and said output voltage for controlling said pass circuit; and a second amplifier, programming said first reference signal for said constant current in response to a second reference signal and said output current;

wherein said first amplifier controls said pass circuit to decrease said output voltage when said output current is high.

16. The low drop-out regulator as claimed in claim 15, wherein said first reference signal is developed by a current source and a resistor, said current source is coupled to said first amplifier, said resistor is coupled between said first amplifier and a ground.

17. The low drop-out regulator as claimed in claim 16, further comprising a capacitor coupled to said first amplifier for a soft-start function.

18. The low drop-out regulator as claimed in claim 15, wherein said second amplifier modulates a programmable current coupled to said first reference signal to program said first reference signal.

19. The low drop-out regulator as claimed in claim 18, wherein said programmable current flows through a transistor coupled to said second amplifier, said second amplifier controls a gate of said transistor for modulating said programmable current.

20. A low drop-out regulator comprising:

an unregulated DC input terminal, receiving an input voltage;

a regulated DC output terminal;

a pass circuit, coupled between said unregulated DC input terminal and said regulated DC output terminal for supplying a power to said regulated DC output terminal; and an amplifying circuit, controlling said pass circuit of said low drop-out regulator for providing a constant voltage or/and a constant current in response to a reference signal and an output current;

wherein said reference signal is utilized to judge said output current for controlling said pass circuit; said reference signal is programmed in response to an output voltage.

21. The low drop-out regulator as claimed in claim 20, wherein said amplifying circuit includes:

a first amplifier, controlling said pass circuit in response to said reference signal and said output current; and a second amplifier, programming said reference signal in response to another reference signal and said output voltage;

wherein said first amplifier controls said pass circuit to decrease said output voltage when said output current is high, said first amplifier controls said pass circuit to increase said output voltage when said output current is low, said reference signal for said first amplifier controlling said pass circuit is developed by a current source and a resistor, said current source is coupled to said first amplifier, said resistor is coupled between said first amplifier and a ground.

22. The low drop-out regulator as claimed in claim 21, further comprising a capacitor coupled to said first amplifier for a soft-start function.

23. The low drop-out regulator as claimed in claim 20, wherein said amplifying circuit includes:

a first amplifier, controlling said pass circuit in response to said reference signal and said output current; and a second amplifier, programming said reference signal in response to another reference signal and said output voltage;

wherein said first amplifier controls said pass circuit to decrease said output voltage when said output current is high, said first amplifier controls said pass circuit to increase said output voltage when said output current is low, said second amplifier modulates a programmable current coupled to said reference signal which is for said first amplifier controlling said pass circuit to program said reference signal.

24. The low drop-out regulator as claimed in claim 23, wherein said programmable current flows through a transistor coupled to said second amplifier, said second amplifier controls a gate of said transistor for modulating said programmable current.

* * * * *